US008264159B2

(12) United States Patent
Dellian et al.

(10) Patent No.: US 8,264,159 B2
(45) Date of Patent: Sep. 11, 2012

(54) CIRCUIT ARRANGEMENT AND METHOD FOR OPERATING AT LEAST ONE LED AND AT LEAST ONE FLUORESCENT LAMP

(75) Inventors: Harald Dellian, Edling (DE); Felix Franck, Munich (DE)

(73) Assignee: Osram AG, Munich (DE)

( * ) Notice: Subject to any disclaimer, the term of this patent is extended or adjusted under 35 U.S.C. 154(b) by 416 days.

(21) Appl. No.: 12/663,289

(22) PCT Filed: Jun. 29, 2007

(86) PCT No.: PCT/EP2007/056534

§ 371 (c)(1),
(2), (4) Date: Dec. 7, 2009

(87) PCT Pub. No.: WO2009/003509

PCT Pub. Date: Jan. 8, 2009

(65) Prior Publication Data

US 2010/0164389 A1 Jul. 1, 2010

(51) Int. Cl.
*H05B 41/00* (2006.01)

(52) U.S. Cl. ..... 315/209 CD; 315/209 R; 315/210; 315/312

(58) Field of Classification Search ..... 315/209 CD, 315/210, 312, 209 R
See application file for complete search history.

(56) References Cited

U.S. PATENT DOCUMENTS

| | | | | |
|---|---|---|---|---|
| 6,400,104 | B1 * | 6/2002 | Ham | 315/312 |
| 7,557,523 | B2 * | 7/2009 | Goriki et al. | 315/308 |
| 7,759,880 | B2 * | 7/2010 | Maros et al. | 315/307 |
| 2006/0290299 | A1 * | 12/2006 | Busse et al. | 315/312 |
| 2009/0146539 | A1 | 6/2009 | Custodis et al. | |

FOREIGN PATENT DOCUMENTS

| | | | |
|---|---|---|---|
| DE | 102005032315 | A1 | 1/2007 |
| GB | 2334832 | A | 9/1999 |
| JP | 2006100129 | A | 4/2006 |
| JP | 2007227342 | A | 9/2007 |
| JP | 2007311317 | A | 11/2007 |
| WO | 02062106 | A1 | 8/2002 |

OTHER PUBLICATIONS

International Search Report of PCT/EP2007/056534, dated Mar. 13, 2008.
English Language Abstract of JP 2007227342 A. Sep. 6, 2007.
English Language Abstract of JP 2007311317 A. Nov. 29, 2007.
English Language Abstract of JP 2006100129 A. Apr. 13, 2006.

* cited by examiner

*Primary Examiner* — Jacob Choi
*Assistant Examiner* — Anthony Arpin

(57) ABSTRACT

A circuit arrangement for operating an LED and an fluorescent lamp may include a main rectifier; an auxiliary rectifier; an inverter, the output of said inverter having a terminal for connecting the fluorescent lamp; a starting device, wherein its first terminal is coupled to a control electrode of one of the switches of the inverter; a pull-down circuit; and a starting capacitor; wherein the second terminal of the starting device and the second terminal of the pull-down circuit are coupled to the first output terminal of the auxiliary rectifier; wherein the starting capacitor is coupled between the first and the second output terminal of the auxiliary rectifier; and wherein there is arranged in parallel with the starting capacitor a series circuit including a first and a second terminal for the LED and an LED switch, wherein the LED switch has a control electrode, an operating electrode and a reference electrode.

16 Claims, 4 Drawing Sheets

CIRCUIT ARRANGEMENT AND METHOD FOR OPERATING AT LEAST ONE LED AND AT LEAST ONE FLUORESCENT LAMP

RELATED APPLICATIONS

The present application is a national stage entry according to 35 U.S.C. §371 of PCT application No.: PCT/EP2007/056534 filed on Jun. 29, 2007.

BACKGROUND

The present invention relates to a circuit arrangement for operating at least one LED and at least one fluorescent lamp including an input having a first and a second input terminal for connecting an AC supply voltage; a main rectifier having a first and a second input terminal and a first and a second output terminal, wherein the first and the second input terminal of the main rectifier are coupled to the first and the second input terminal for connecting the AC supply voltage, an auxiliary rectifier having a first and a second input terminal and a first and a second output terminal wherein the first and the second input terminal of the auxiliary rectifier are coupled to the first and the second input terminal for connecting the AC supply voltage, an inverter including at least one series circuit formed by a first and a second switch wherein the series circuit is coupled to the first and the second output terminal of the main rectifier, and the output of the inverter having at least one terminal for connecting the fluorescent lamp wherein the first and the second switch each have a control electrode, an operating electrode and a reference electrode, a starting device having a first and a second terminal, wherein its first terminal is coupled to a control electrode of one of the switches of the inverter, a pull-down circuit having a first and a second terminal, wherein its first terminal is coupled to the output of the inverter, and a starting capacitor for providing energy for the starting device.

The invention furthermore relates to a method for operating at least one LED and at least one fluorescent lamp using a circuit arrangement of this type, wherein the second terminal of the starting device and the second terminal of the pull-down circuit are coupled to the first output terminal of the auxiliary rectifier, wherein the starting capacitor is coupled between the first and the second output terminal of the auxiliary rectifier, and wherein there is arranged in parallel with the starting capacitor a series circuit including a first and a second terminal for the least one LED and an LED switch, wherein the LED switch has a control electrode, an operating electrode and a reference electrode, and a timer having a timer capacitor.

FIG. 1 shows a generic circuit arrangement known from the prior art. This circuit arrangement has an input having a first E1 and a second input terminal E2. Via the first E1 and the second input terminal E2, the circuit arrangement can be coupled to a power supply system voltage $U_N$ by means of a switch S. The circuit arrangement includes a main rectifier 12 including the diodes D5, D6, D7, D8. The input of the main rectifier 12 is coupled to the input terminals E1, E2. The circuit arrangement furthermore includes an auxiliary rectifier including the diodes D1, D2, D3 and D4. The input of the auxiliary rectifier 14 is likewise coupled to the first E1 and the second input terminal E2. Furthermore, an inverter 16 is provided, which, in the present case, is embodied as a half-bridge circuit and includes a first switch Q1 and a second switch Q2, which are connected in series with one another. This series circuit is coupled to the first A11 and the second output terminal A12 of the main rectifier 12, wherein the voltage provided between the two output terminals A11, A12, which voltage is usually referred to as the intermediate circuit voltage, is backed up by a capacitor C3. The output terminal of the inverter 16 is coupled to a fluorescent lamp LA. The first Q1 and the second switch Q2 each have a control electrode, an operating electrode and a reference electrode. A DIAC D14 is provided as a starting device and one of its terminals is coupled to the control electrode of the switch Q2 of the inverter 16. Moreover, a pull-down circuit 81 is provided, which is formed by the diode D10 in the present case, wherein one of the terminals of the diode D10 is coupled to the output of the inverter 16. Finally, a starting capacitor C1 is provided, which is charged via the nonreactive resistor R1 (first pull-up resistor) and which serves to provide energy for the starting device D14. In the time between the coupling of a power supply system voltage as a result of the closing of the switch S and the starting of the inverter 16 by the DIAC D14, the second pull-up resistor R1 conditions the inverter 16 in such a way that, at the inverter switch whose control electrode is coupled to the starting device, directly before the starting, a voltage greater than zero is present in order to ensure the starting of the inverter 16. Therefore, the resistor is considered to be among the component parts of the inverter 16.

A first LD5 and a second LED LD6 are coupled to the output of the auxiliary rectifier 14 and can be switched on and off by means of a switching transistor Q3. A nonreactive resistor R9 acts as a current limiting resistor.

Proceeding from an off state of this circuit arrangement illustrated in FIG. 1, after the switch S has been switched on once, the LEDs LD5, LD6 are switched on, since the base of the LED switch Q3 is simultaneously brought to a higher potential via the resistor R8 and the LED switch therefore switches on. Timing control is effected via the nonreactive resistor R10 and the capacitor C6 and is referred to hereinafter as LED switch-off delay. In parallel with this, the collector of the transistor Q4 is connected via the nonreactive resistor R1 to the high potential at the output of the main rectifier 12. The base of the transistor Q4 is likewise connected to the high potential at the output of the main rectifier 12 via a timing switching element including the resistors R3 and R4 and also the capacitor C8. The switch-on of the transistor Q4 is delayed by the charge of the capacitor C8. However, the corresponding components are dimensioned such that Q4 becomes conducting before a voltage that would suffice for triggering the DIAC D14 is present at the capacitor C1. The capacitor C1 is likewise coupled to the output A11, A12 of the main rectifier 14 via the nonreactive resistor R1 and is therefore likewise charged. Since the switching transistor Q4 becomes conducting before a voltage sufficient for triggering the DIAC D14 is present at the capacitor C1, the voltage preferably being 33 V or 34 V, the DIAC D14 is not triggered in this situation, for which reason the fluorescent lamp LA remains switched off. Therefore, the combination of the components R3, R4, R5, C8 and Q4 illustrated here is referred to hereinafter as inverter starting preventing device 19. What is important in this case, moreover, is that when the device 19 is active, the starting capacitor is only partly discharged preferably to approximately 20 V. This is achieved by the fact that the impedance from the parallel circuit formed by R3 and R4 divided by the impedance of R1 results approximately in the current gain of the transistor Q4.

If the switch S is then switched off briefly and immediately switched on again, the LEDs LD5, LD6 come on again after the sequence already described. What is crucial, then, is that the capacitor C1 retained a residual voltage during the brief switched-off duration, while the capacitor C8 was discharged via the resistor R4. When the switch S is switched on again, the capacitor C1 therefore has a charge lead over the capacitor C8. This has the effect that the voltage across the capacitor C1 rises to such an extent that the DIAC D14 triggers before the voltage present at the base of the transistor Q4 would suffice to turn on the transistor Q4. As a consequence, the inverter 16 is put into operation, whereby the fluorescent lamp LA is switched on in addition to the LEDs. By means of an LED switch-off device 18, if the inverter 16 is in operation, by means of a fourth winding of the transformer L2 (T) provided therein, the base of the LED switch Q3 is depleted, whereby the LEDs LD5, LD6 are switched off.

The components illustrated in FIG. 1 which have not been mentioned are of secondary importance for understanding the present invention and will therefore not be explicitly introduced. The circuit arrangement illustrated in FIG. 1 basically has two complete energy supplies, a first for the fluorescent lamp and a second, which is branched off in parallel at the AC voltage supply system, with a dedicated full-bridge rectifier including 600 V diodes, and also a series resistor and a switching transistor for the at least one LED. The LED switch is switched to be conductive by means of a pull-up circuit and is switched off by an inversely acting circuit as soon as the inverter oscillates. This requires a series resonant circuit, which is driven in floating fashion by a fourth winding L2 (T) on the half-bridge driving transformer T. The other three windings serve for driving the two switches of the inverter. Preventing the inverter from starting to oscillate is performed by an independent timing circuit, the inverter starting preventing device 19 already mentioned above.

The circuit arrangement from FIG. 1 exhibits a number of disadvantages: thus, the auxiliary rectifier 14 is a rectifier that has to be designed for 600 V if the circuit arrangement is intended to be connected to a customary AC voltage supply system. Since almost the entire output voltage of the auxiliary rectifier 14 is present during operation of the at least one light emitting diode solely at the nonreactive resistor R9, the auxiliary rectifier has to be dimensioned for a large power loss, and thereby considerably reduces the efficiency of the circuit arrangement. The LED switch Q3 has to be able to block up to 600 V in the switched-off state, that is to say when the inverter 16 is active.

A further disadvantage consists in the presence of three timing circuits that are totally independent of one another, namely the LED switch-off delay including R10 and C6, the inverter starting circuit including R1 and C1, and also the inverter starting delay device 19, all three of which together are intended to control an either-or process. The smooth functioning of this system can be achieved exclusively by exact dimensioning of all the components involved, for which reason the overall circuit is extremely susceptible to component and manufacturing tolerances.

SUMMARY

Various embodiments provide a circuit arrangement mentioned in the introduction and a method mentioned in the introduction such that more favorable efficiency can be obtained, the sensitivity of the circuit toward tolerances can be reduced and more cost-effective components can be used for the realization.

Various embodiments are based on the insight that the above effects can be achieved if the starting capacitor is no longer charged from the main rectifier, but rather from the auxiliary rectifier. It should therefore be coupled between the first and the second output terminal of the auxiliary rectifier. Furthermore, there is arranged in parallel with the starting capacitor a series circuit including a first and a second terminal for the at least one LED and an LED switch, wherein the LED switch has a control electrode, an operating electrode and a reference electrode. In this case, the auxiliary rectifier should only be dimensioned for the voltage that suffices for triggering the starting device, that is to say the DIAC, for example. Voltages that arise in this case are smaller by a factor of 10 than in the case of the auxiliary rectifier in accordance with the prior art. In this respect, the LED switch can be dimensioned for a significantly lower reverse voltage. The nonreactive resistor R9 from the prior art is no longer necessary. Moreover, the timing control can be embodied more simply: as long as the LEDs are luminous, that is to say that the voltage present across the capacitor C1, and hence that present at the starting device, is less than the triggering voltage of the starting device, the fluorescent lamp cannot come on. Moreover, it is provided that the second terminal of the starting device and the second terminal of the pull-down circuit are coupled to the first output terminal of the auxiliary rectifier. This has the effect that, if the fluorescent lamp is luminous, the starting capacitor is discharged via the pull-down circuit, such that the voltage present at the at least one LED lies below the forward voltage thereof and the at least one LED is thus definitely off.

Moreover, this means that there is no longer a need for two auxiliary transistors, as was the case in the prior art, rather just one suffices. The fourth winding on the driver transformer for the switches of the inverter, said fourth inverter having a highly negative influence on the operation of the fluorescent lamp, can likewise be obviated. As a result of the coupling to the starting circuit, the entire subcircuit required for the operation of the LEDs is reliably limited to the triggering voltage of the starting device. The switching logic is reversibly unambiguously linked to the voltage levels at the starting capacitor; only the switch-on of the at least one LED is time-controlled. This means that undesirable switching combinations are reliably precluded. Moreover, a power supply system diode (diode D9 in the prior art) is obviated on account of the skillful connection of the timing control pull-up. The pull-up resistor R1 can likewise be obviated, in the same way as the circuit elements for extracting the charge carriers from the base of the LED switch.

Particularly preferably, a circuit arrangement according to the invention furthermore includes a timer, the input of which is coupled to the first and/or the second input terminal of the input, and the first output terminal of which is coupled to the control electrode of the LED switch, and the second output terminal of which is coupled to the reference electrode of the LED switch. This timing control manages without a dedicated transistor, rather it drives the LED switch already arranged in series with the at least one LED. It can therefore be realized with very little outlay.

Preferably, the timer includes, between its first and its second output terminal, the parallel circuit formed by a timer capacitor and a first nonreactive resistor, wherein the timer furthermore includes a second nonreactive resistor, which is coupled between the input of the timer and its first output terminal, wherein the voltage dropped across the parallel circuit is coupled to the output of the timer. By virtue of the first nonreactive resistor being connected in parallel with the timer capacitor, it can be ensured that the voltage present at the control electrode of the LED switch drops after the AC voltage supply has been turned off, whereas the charge stored on the starting capacitor is maintained for a long period of time since no nonreactive resistor is connected in parallel with the starting capacitor. The second nonreactive resistor brings the "tapped" AC supply voltage to a level for driving the LED switch.

Preferably, the timer furthermore includes a third nonreactive resistor, wherein the second nonreactive resistor is coupled between the first input terminal of the input and the first output terminal of the timer and wherein the third nonreactive resistor is coupled between the second input terminal of the input and the first output terminal of the timer. The reliable switch-on of the at least one LED can thus be ensured independently of the present phase of the AC supply voltage connected to the input.

It is furthermore preferred that a first diode is coupled between the two output terminals of the timer, said diode being oriented in such a way that it prevents a current flow from the timer capacitor to the output of the timer.

This ensures that the LED switch is driven only via the second or the third nonreactive resistor. This is because the first diode ensures that no charge carriers from the timer capacitor can pass to the control electrode of the LED switch.

It is furthermore preferred that a resistive voltage divider is coupled between the two output terminals of the timer, the tap of said voltage divider being coupled to the control electrode of the LED switch. Said voltage divider serves for quasi artificially increasing the potential between control and reference electrodes of the LED switch. In a development of this embodiment, it can be provided that the part of the voltage divider which is coupled between the first output terminal of the timer and the control electrode of the LED switch includes a second diode which is oriented in such a way that it prevents a current flow from the control electrode of the LED switch to the output of the timer. What is thereby achieved is that the depletion of the control electrode of the LED switch is solely realized only by the resistor between control electrode and reference electrode of the LED switch or respectively second output terminal of the timer (that is to say by the lower part of said voltage divider), which is advantageous for the tolerance behavior of the circuit. Furthermore, the switch-off of the LED switch is accelerated because, in particular, the reaction of the LED switch driving to falls in the voltages at the inputs of the timer is digitized. Both lead to a reliable and rapid switch-off of the LED switch which is correspondingly required by the timer.

It has proved to be advantageous if a circuit arrangement according to the invention furthermore includes an electrical coupling between the operating electrode of the LED switch and the first output terminal of the timer, which electrical coupling is embodied in such a way that it brings about current negative feedback of the LED switch. This achieves the advantage that the LED switch never attains deep saturation and, as a result, turns off somewhat more rapidly and primarily more reliably since this process has now become independent of the storage time of the LED switch. Although the turn-off itself does not become "sharper", tolerance-dependent time delays are none the less minimized.

A further preferred embodiment is distinguished by the fact that the operating electrode of the LED switch is coupled to the first output terminal of the timer via a third diode which is oriented in such a way that it acts as an antisaturation diode for the LED switch. This ensures that the LED switch turns off even more rapidly, that is to say that the small disadvantage associated with the current negative feedback is resolved as well, and the fluorescent lamp comes on even more reliably in return. It thus serves for stabilizing the charge lead of the starting capacitor.

Furthermore, it is preferred if the timer and the starting capacitor, proceeding from a charge state of the starting capacitor below a predefineable limit value, are designed, after the AC supply voltage has been applied to the circuit arrangement, to switch on the LED switch before a voltage sufficient for triggering the starting device is present at the starting capacitor. If the circuit arrangement is in the off state, firstly the at least one LED is therefore switched on after the switch S has been switched on, which switch can be, in particular, a customary wall switch, for example. Since the LED switch begins to conduct before a voltage sufficient for triggering the starting device is present at the starting capacitor, and the voltage at the starting capacitor is thus inherently clamped to the forward voltages of the at least one LED and the operating voltage of the LED switch, the fluorescent lamp remains switched off.

In this context, it is furthermore preferred that the timer and the starting capacitor, proceeding from a charge state of the starting capacitor above a predefinable limit value, are designed, after the AC supply voltage has been applied, to trigger the starting device before a voltage sufficient for switching on the LED switch is present at the control electrode of the LED switch. Accordingly, if a circuit arrangement according to the invention that has already been operated for a short period of time is briefly switched off and switched on again the starting capacitor retains a charge lead over the timer capacitor. Both are charged again but now, on account of the charge lead, the starting capacitor reaches the voltage necessary for triggering the starting device before a voltage sufficient for switching on the LED switch is present at the control electrode of the LED switch. As a result, the starting device is triggered and the fluorescent lamp is put into operation. Even though the voltage between control and reference electrodes of the LED switch consequently increases to an extent such that the LED switch attains the on state, the LEDs remain off, however, since the supply of the at least one LED, representing the voltage at the starting capacitor, after the triggering of the starting device, on account of a pull-down circuit, has collapsed to values that are too small for it to suffice to drive a current through the at least one LED and the one LED switch.

Preferably, the pull-down circuit includes the series circuit formed by a nonreactive resistor and a diode. It should be taken into account here that the pull-down resistor can in this case be designed for smaller voltages than the pull-up resistor in the prior art and can therefore be realized more cost-effectively.

In one preferred embodiment, a first capacitor is coupled between the first input terminal of the input and the first input terminal of the auxiliary rectifier and a second capacitor is coupled between the second input terminal of the input and the second input terminal of the auxiliary rectifier. These perform the function of electrical DC decoupling between the main supply by the main rectifier and the auxiliary supply by the auxiliary rectifier and also current limiting of the current through the at least one LED ($I_{LED}=(C_{L1}/2)*\delta U_N/\delta t$). Preferably, a third capacitor is coupled between the first input terminal and the second input terminal of the auxiliary rectifier. The third capacitor acts as an EMC capacitor and is connected in series with the first and the second capacitor. Therefore, only a very small voltage is present across it, for which reason reduced safety requirements are applicable and said third capacitor can be realized very cost-effectively. The first and the second capacitor are preferably of identical size.

Finally, it is preferred if the auxiliary rectifier is dimensioned to provide a voltage at its output which corresponds to at most 110% of the trigger voltage of the starting device, in particular at most 35 V. The auxiliary rectifier is thus dimensioned for a fraction of the voltage in relation to the auxiliary rectifier in the circuit arrangement known from the prior art.

The embodiments presented with respect to the circuit arrangement according to various embodiments and their advantages likewise hold true, insofar as is applicable, for the method according to various embodiments.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
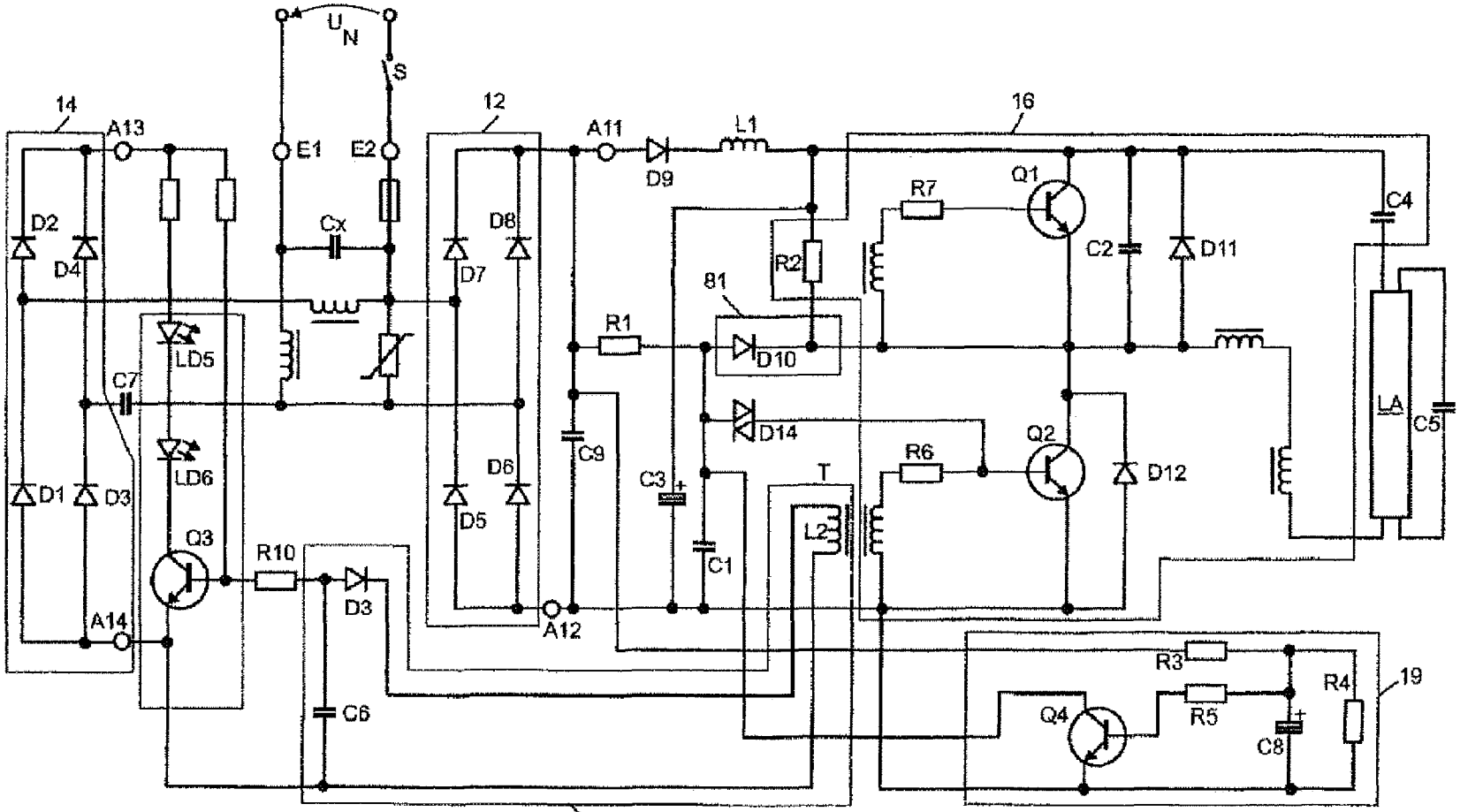
FIG 1 Prior Art
FIG. 1 shows in schematic illustration a circuit arrangement for operating at least one LED and at least one fluorescent lamp that is known from the prior art.

The reference symbols that have already been introduced with reference to FIG. 1 will continue to be used below for identical or functionally identical components. They will not be introduced again, for the sake of clarity.

Figure 2:
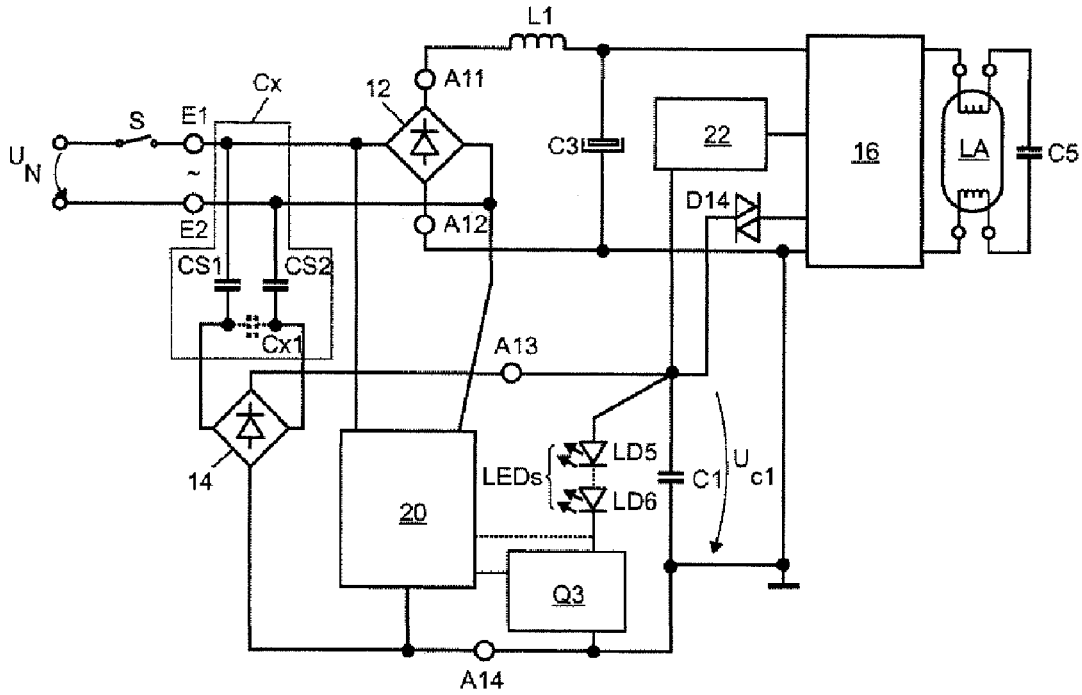
FIG. 2 shows in schematic illustration a circuit arrangement according to the invention.

FIG. 2 shows in schematic illustration the construction of a circuit arrangement according to the invention. The input terminals E1, E2 can be coupled to an AC supply voltage $U_N$ representing the power supply system voltage, in particular, via a switch S. In this case, the input terminals E1 and E2 are coupled to a main rectifier 12. Moreover, the input terminal E1 is coupled to the first input terminal of an auxiliary rectifier 14 via a capacitor $C_{S1}$ and the second input terminal E2 is coupled to the second input terminal of the auxiliary rectifier 14 via a second capacitor $C_{S2}$. Moreover, an X-capacitance $C_{X1}$ is coupled between the two inputs of the auxiliary rectifier. The combination of the capacitors $C_{S1}$, $S_{S2}$ and $C_{X1}$ corresponds to the capacitor $C_X$ from FIG. 1. The output voltage of the main rectifier 12 is backed up by a capacitor $C_3$ and provided to an inverter 16. The output of the inverter is coupled to a fluorescent lamp LA, wherein a capacitor C5 is provided as triggering capacitor. Moreover, the input terminals E1, E2 of the main rectifier 12 are coupled to the input of a timer 20, the first output terminal of which is coupled to the control electrode of the LED switch Q3 and the second output terminal of which is coupled to the reference electrode of the LED switch Q3. As is depicted by dashes, a coupling of the timer 20 to the operating electrode of the LED switch Q3 can be provided, moreover. A starting capacitor C1 is coupled between the outputs A13 and A14 of the auxiliary rectifier 14, a voltage $U_{C1}$ being stored in the starting capacitor. Coupled in parallel with the starting capacitor C1 is the series circuit formed by a plurality of LEDs, wherein the LEDs LD5 and LD6 are illustrated by way of example in the present case, and also the path operating electrode—reference electrode of the LED switch Q3. Moreover, the voltage $U_{C1}$ is present at one terminal of the DIAC D14, the other terminal of which is coupled to the control electrode of a switch of the inverter 16. The midpoint of the inverter 16, which includes at least two switches (not illustrated), is likewise coupled to the voltage $U_{C1}$ via a pull-down circuit 22.

Figure 3:
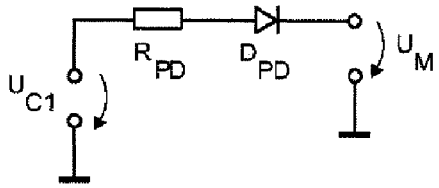
FIG. 3 shows in schematic illustration the construction of an exemplary embodiment of the pull-down circuit.

FIG. 3 shows an exemplary embodiment of the pull-down circuit 22. The latter includes the series circuit formed by a nonreactive resistor $R_{PD}$ and a diode $D_{PD}$. This series circuit is coupled firstly between the positive pole of the voltage $U_{C1}$ and the midpoint of the bridge circuit of the inverter, at which the voltage $U_M$ is present.

Figure 4:
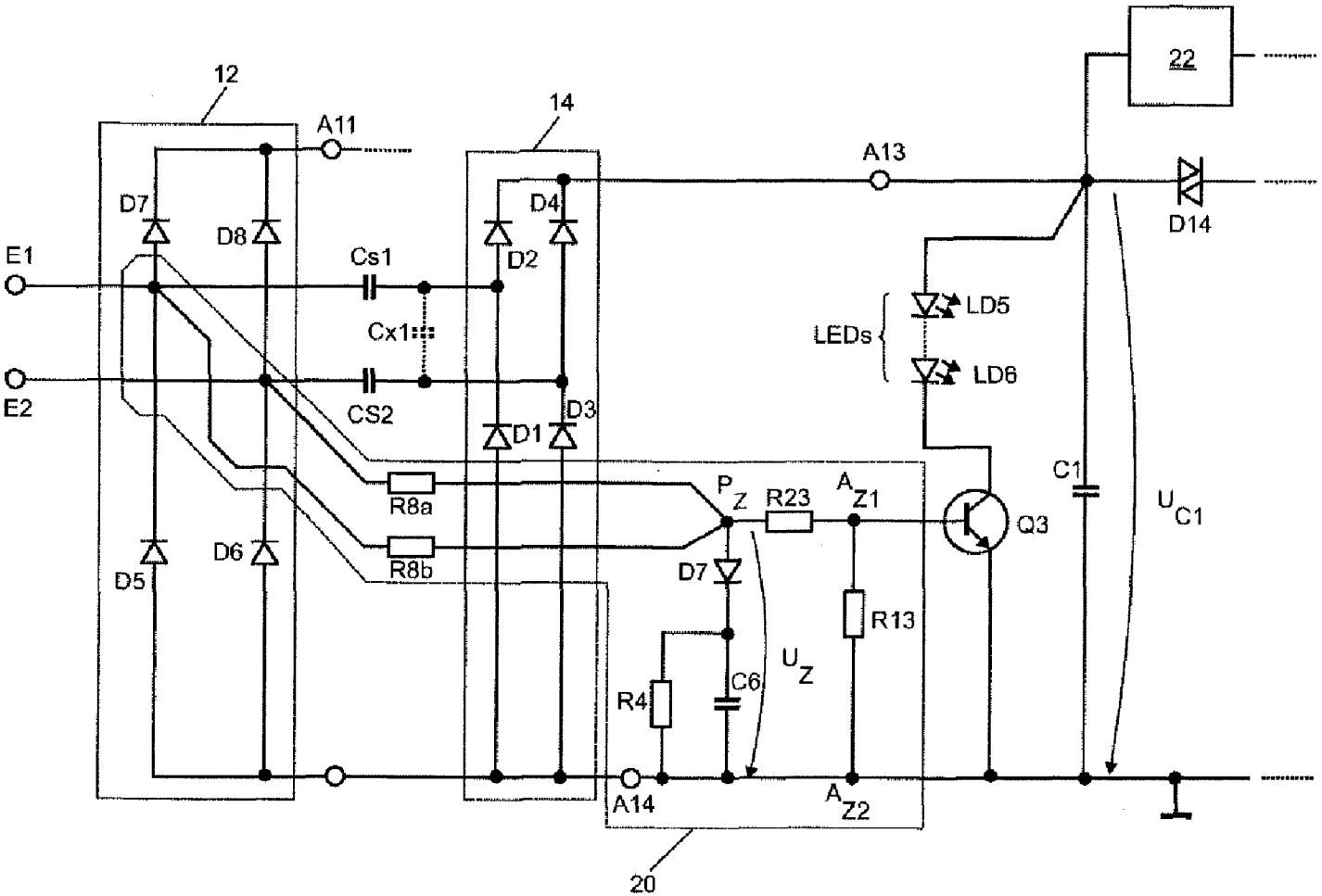
FIG. 4 shows in schematic detailed illustration a part of the circuit arrangement according to the invention from FIG. 2.

FIG. 4 shows in detailed illustration an excerpt from the circuit arrangement from FIG. 2. The timing control 20 is depicted by dashed lines, one input of said timing control being coupled to the input terminal E1 and the other input of said timing control being coupled to the input terminal E2. A respective nonreactive resistor $R_{8a}$, $R_{8b}$ is coupled between the respective input terminal and a point $P_Z$. These two nonreactive resistors serve to ensure a suitable driving of the LED switch Q3, independently of the present phase of the AC supply voltage $U_N$ upon switch-on. The voltage at the point $P_Z$ is designated by $U_Z$ hereinafter.

The point $P_Z$ is connected to the ground potential via a diode D7 and the parallel circuit formed by a nonreactive resistor R4 and a capacitor C6. The diode D7 ensures that the charge carriers pass only via one of the resistors $R_{8a}$, $R_{8b}$ to the control electrode of the LED switch Q3, i.e. in particular no charge carriers from the capacitor C6. Furthermore, a voltage divider including the resistors R23 and R13 is coupled to the point $P_Z$ wherein the tap of the voltage divider constitutes a first output terminal $A_{Z1}$ of the timing control 20, this output terminal being coupled to the control electrode of the LED switch Q3. The second output terminal $A_{Z2}$ of the timing control 20 is formed by the reference potential.

Figure 5:
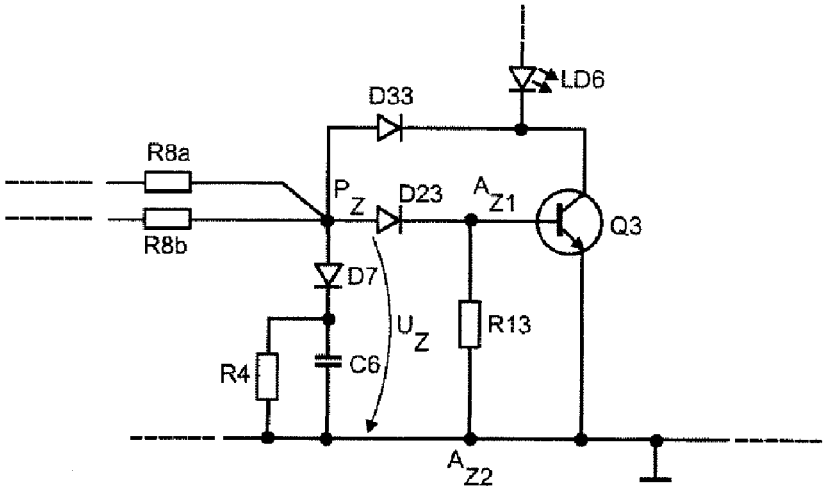
FIG. 5 shows in schematic illustration a driving of the LED switch that is modified by comparison with the illustration in FIG. 4.

FIG. 5 shows an alternative embodiment of the timing control 20. In this case, instead of the nonreactive resistor R23, a diode D23 is arranged between the point $P_Z$ and the first output $A_{Z1}$ of the timing control 20. Moreover, the point $P_Z$ is coupled to the operating electrode, i.e. in the present case the collector, of the LED switch Q3 via a diode D33. The diode D33 acts as an antisaturation diode for the LED switch Q3. This ensures that the LED switch Q3 switches off even more rapidly, and in return the fluorescent lamp LA comes on even more reliably. It thus serves for stabilizing the charge lead of the starting capacitor C1.

Figure 6:
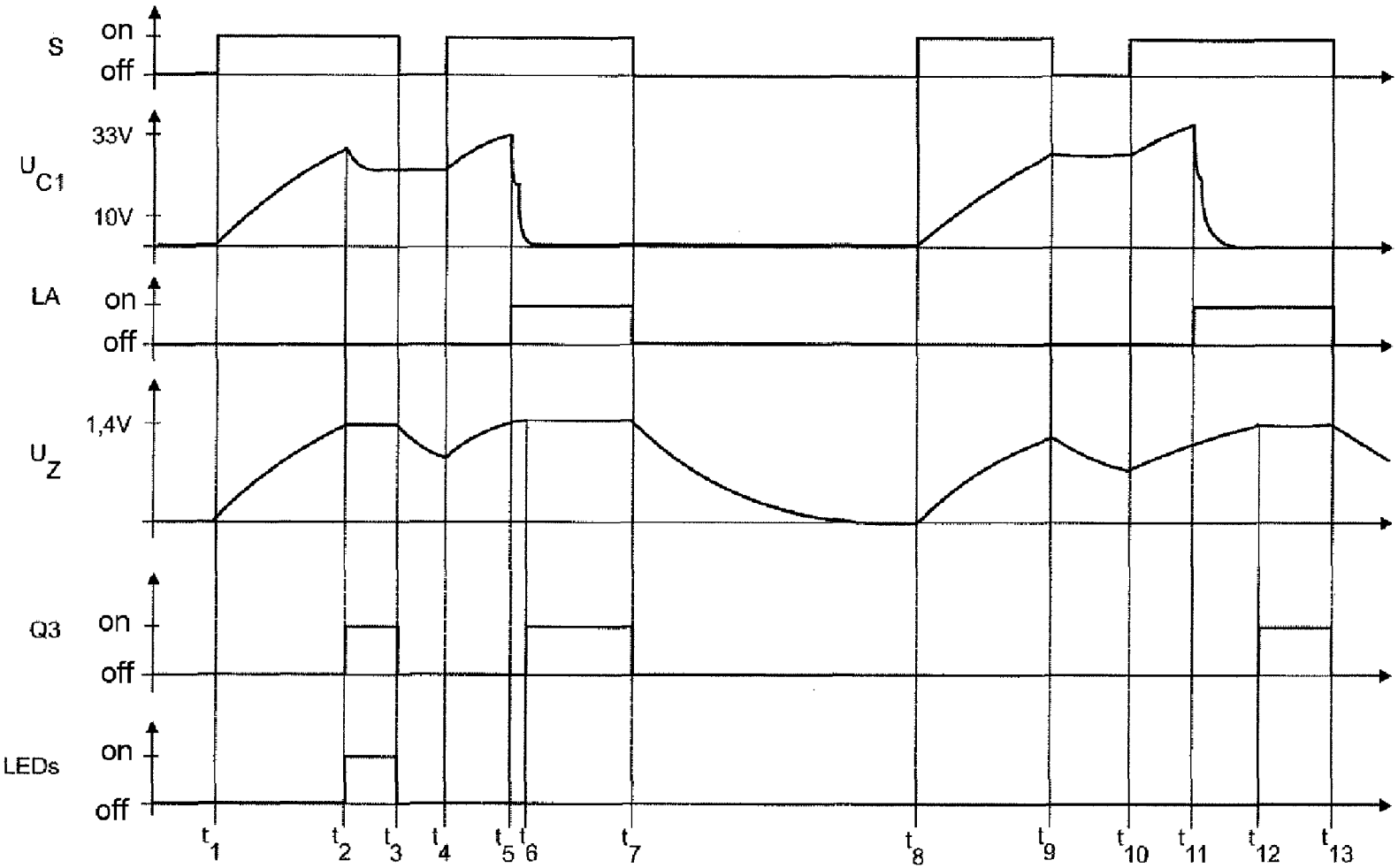
FIG. 6 shows the temporal profile of various quantities from FIGS. 2 and 4 when realizing the driving of the LED switch in accordance with FIG. 5.

FIG. 6 shows the temporal profile of a plurality of quantities of a circuit arrangement according to the invention, wherein the variant with the antisaturation diode D33 was used within the timing control 20. The topmost profile concerns the position of the switch S. The second profile shows the voltage at the starting capacitor C1, which corresponds to the voltage at the DIAC D14. The third profile concerns the fluorescent lamp LA and shows the off and on states thereof. The fourth profile represents the voltage $U_Z$ at the point $P_Z$. The fifth profile concerns the switching state of the LED switch Q3, and the sixth profile concerns the switching state of the LEDs LD5, LD6.

At the instant $t_1$, the switch S1 is switched on. As a result, the capacitor C1 is gradually charged, and the voltage $U_{C1}$ rises. In the same way, the capacitor C6 is charged via one of the resistors $R_{8a}$, $R_{8b}$ and the diode D7, that is to say that the voltage $U_Z$ likewise rises. At the instant $t_2$ the voltage $P_Z$ reaches a value which has the effect that the LED switch Q3 switches on. On account of the fact that the voltage $U_{C1}$ supplying the series circuit formed by the LEDs and the path operating electrode—reference electrode of the LED switch Q3 is sufficiently high, the LEDs are thereby switched on. Through the supply of the LEDs, the voltage $U_{C1}$ decreases slightly. What is important is that already at the instant $t_2$ the voltage $U_{C1}$ is less than the triggering voltage of the DIAC D14. If the switch S is switched off at the instant $t_3$ the LED switch Q3 is thereby also switched off. As a result, a current flow through the LEDs is no longer possible; the latter are therefore likewise switched off.

What is of importance is that up to the instant $t_4$ the voltage $U_{C1}$ at the starting capacitor C1 remains virtually constant for lack of parallel connection of a nonreactive resistor and preferably as a result of the LEDs being rapidly turned off by means of the LED switch. By contrast, the voltage $U_Z$ falls since the timer capacitor C6 is discharged via the nonreactive resistor $R_4$. If the switch S is then switched on again at the instant $t_4$, the starting capacitor C1 has a charge lead over the timer capacitor C6. The voltage $U_{C1}$ rises again, as does the voltage $U_Z$. At the instant $t_5$, the voltage $U_{C1}$, which is identical to the voltage present at the DIAC D14, is so large that the DIAC triggers. As a result, the voltage $U_{C1}$ firstly dips by approximately one third of its peak value; the inverter 16 is activated and the fluorescent lamp LA is switched on. At the same time, said pull-down circuit becomes active and causes the starting capacitor C1 to be discharged to approximately zero volts. Even though at the instant $t_6$ the voltage $U_Z$ has again reached a value sufficient for switching on the LED switch Q3, the LEDs nevertheless remain off since, owing to the dip in the voltage $U_{C1}$, no supply is available for the LEDs. If the switch S is switched off again at the instant $t_7$, the fluorescent lamp LA and the LED switch Q3 are thereby switched off.

Although the progression between the time periods $t_1$ and $t_7$ shows a procedure in which firstly the LEDS were switched on and then the fluorescent lamp LA, the profile between the instants $t_8$ and $t_{13}$ shows how it is possible to have the effect that solely the fluorescent lamp LA can be switched on without a prior switch-on of the LEDs LD5, LD6. For this purpose, the switch S is switched on at the instant $t_8$. Consequently, the voltage $U_{C1}$ and the voltage $U_Z$ rise. If switch-off is then already effected at the instant $t_9$ that is to say at an instant at which the voltage $U_z$ still does not suffice to turn on the LED switch Q3, both the fluorescent lamp LA and the LEDs remain off. Between the instants $t_9$ and $t_{10}$, the voltage $U_{C1}$ at the starting capacitor C1 remains substantially constant, while the voltage $U_Z$ falls on account of the fact that the timing capacitor C6 is discharged via the nonreactive resistor R4. If the switch S is switched on again at the instant $t_{10}$ both the voltage $U_{C1}$ and the voltage $U_Z$ rise. On account of the charge lead of the starting capacitor C1, a voltage $U_{C1}$ sufficient to trigger the DIAC is then attained at the instant $t_{11}$. As a result, the inverter 16 is activated, and the fluorescent lamp LA is switched on. Although up to the instant $t_{12}$ the voltage $U_Z$ likewise rises to such an extent that the LED switch Q3 is switched on, the LEDs remain off since the voltage $U_{C1}$ supplying the LEDs has fallen to virtually zero volts as a result of the action of the pull-down circuit. At the instant $t_{13}$ the switch S is switched off again, whereby the fluorescent lamp and the LED switch Q3 are also switched off again.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A circuit arrangement for operating at least one LED and at least one fluorescent lamp, the circuit arrangement comprising: an input having a first and a second input terminal for connecting an AC supply voltage; a main rectifier having a first and a second input terminal and a first and a second output terminal, wherein the first and the second input terminal of the main rectifier are coupled to the first and the second input terminal for connecting the AC supply voltage; an auxiliary rectifier having a first and a second input terminal and a first and a second output terminal, wherein the first and the second input terminal of the auxiliary rectifier are coupled to the first and the second input terminal for connecting the AC supply voltage; an inverter comprising at least one series circuit formed by a first and a second switch wherein the series circuit is coupled to the first and the second output terminal of the main rectifier, and the output of said inverter having at least one terminal for connecting the fluorescent lamp, wherein the first and the second switch each have a control electrode, an operating electrode and a reference electrode; a starting device having a first and a second terminal, wherein its first terminal is coupled to a control electrode of one of the switches of the inverter; a pull-down circuit having a first and a second terminal, wherein its first terminal is coupled to the output of the inverter; a starting capacitor for providing energy for the starting device; and a timer, the input of which is directly coupled to at least one of the first and the second input terminal of the input, and the first output terminal of which is directly coupled to the control electrode of the LED switch, and the second output terminal of which is directly coupled to the reference electrode of the LED switch; wherein the second terminal of the starting device and the second terminal of the pull-down circuit are directly coupled to the first output terminal of the auxiliary rectifier; wherein the starting capacitor is directly coupled between the first and the second output terminal of the auxiliary rectifier; and wherein there is arranged in parallel with the starting capacitor a series circuit comprising a first and a second terminal for the at least one LED and an LED switch, wherein the LED switch has a control electrode, an operating electrode and a reference electrode.

2. The circuit arrangement as claimed in claim 1, wherein the timer comprises, between its first and its second output terminal, the parallel circuit formed by a timer capacitor and a first nonreactive resistor, wherein the timer furthermore comprises a second nonreactive resistor, which is coupled between the input of the timer and its first output terminal wherein the voltage dropped across the parallel circuit is coupled to the output of the timer.

3. The circuit arrangement as claimed in claim 2, wherein the timer furthermore comprises a third nonreactive resistor, wherein the second nonreactive resistor is coupled between the first input terminal of the input and the first output terminal of the timer and wherein the third nonreactive resistor is coupled between the second input terminal of the input and the first output terminal of the timer.

4. The circuit arrangement as claimed in claim 1, wherein a first diode is coupled between the two output terminals of the timer, said diode being oriented in such a way that it prevents a current flow from the timer capacitor to the first output terminal of the timer.

5. The circuit arrangement as claimed in claim 1, wherein a resistive voltage divider is coupled between the two output terminals of the timer, the tap of said voltage divider being coupled to the control electrode of the LED switch.

6. The circuit arrangement as claimed in claim 5, wherein the part of the voltage divider which is coupled between the first output terminal of the timer and the control electrode of the LED switch comprises a second diode which is oriented in such a way that it prevents a current flow from the control electrode of the LED switch to the output of the timer.

7. The circuit arrangement as claimed in claim 1, further comprising: an electrical coupling between the operating electrode of the LED switch and the first output terminal of the timer, which electrical coupling is embodied in such a way that it brings about current negative feedback of the LED switch.

8. The circuit arrangement as claimed in claim 6, wherein the operating electrode of the LED switch is coupled to the first output terminal of the timer via a third diode which is oriented in such a way that it acts as an antisaturation diode for the LED switch.

9. The circuit arrangement as claimed in claim 1, wherein the timer and the starting capacitor, proceeding from a charge state of the starting capacitor below a predefineable limit value, are designed, after the AC supply voltage has been applied to the circuit arrangement, to switch on the LED switch before a voltage sufficient for triggering the starting device is present at the starting capacitor.

10. The circuit arrangement as claimed in claim 1, wherein the timer and the starting capacitor, proceeding from a charge state of the starting capacitor above a predefineable limit value, are designed, after the AC supply voltage has been applied, to trigger the starting device before a voltage sufficient for switching on the LED switch is present at the control electrode of the LED switch.

11. The circuit arrangement as claimed in claim 1, wherein the pull-down circuit comprises the series circuit formed by a nonreactive resistor and a diode.

12. The circuit arrangement as claimed in claim 1, wherein a first capacitor is coupled between the first input terminal of the input and the first input terminal of the auxiliary rectifier and a second capacitor is coupled between the second input terminal of the input and the second input terminal of the auxiliary rectifier.

13. The circuit arrangement as claimed in claim 12, wherein a third capacitor is coupled between the first input terminal and the second input terminal of the auxiliary rectifier.

14. The circuit arrangement as claimed in claim 1, wherein the auxiliary rectifier is dimensioned to provide a voltage at its output which corresponds to at most 110% of the trigger voltage of the starting device.

15. A method for operating at least one LED, and at least one fluorescent lamp using a circuit arrangement comprising an input having a first and a second input terminal for connecting an AC supply voltage; a main rectifier having a first and a second input terminal and a first and a second output terminal, wherein the first and the second input terminal of the main rectifier are coupled to the first and the second input terminal for connecting the AC supply voltage; an auxiliary rectifier having a first and a second input terminal and a first and a second output terminal, wherein the first and the second input terminal of the auxiliary rectifier are coupled to the first and the second input terminal for connecting the AC supply voltage; an inverter comprising at least one series circuit formed by a first and a second switch, wherein the series circuit is coupled to the first and the second output terminal of the main rectifier, and the output of said inverter having at least one terminal for connecting the fluorescent lamp, wherein the first and the second switch each have a control electrode, an operating electrode and a reference electrode; a starting device having a first and a second terminal, wherein its first terminal is coupled to a control electrode of one of the switches of the inverter; a pull-down circuit having a first and a second terminal, wherein its first terminal is coupled to the output of the inverter; a starting capacitor for providing energy for the starting device; wherein the second terminal of the starting device and the second terminal of the pull-down circuit are directly coupled to the first output terminal of the auxiliary rectifier; wherein the starting capacitor is directly coupled between the first and the second output terminal of the auxiliary rectifier; and wherein there is arranged in parallel with the starting capacitor a series circuit comprising a first and a second terminal for the at least one LED and an LED switch, wherein the LED switch has a control electrode, an operating electrode and a reference electrode, and a timer having a timer capacitor, wherein the input the timer is directly coupled to at least one of the first and the second input terminal of the input, and the first output terminal of which is directly coupled to the control electrode of the LED switch, and the second output terminal of which is directly coupled to the reference electrode of the LED switch; the method comprising: after the AC supply voltage has been applied: a1) charging the timer capacitor and the starting capacitor; a2) coupling the voltage dropped across the timer capacitor to the control electrode of the LED switch; a3) coupling the voltage dropped across the starting capacitor to the starting device; wherein the following is to be performed depending on the charge state of the starting capacitor: b1) if the charge state of the starting capacitor before AC supply voltage was applied was below a predefineable limit value: switching on the LED switch and thus switching on the at least one LED without triggering the starting device; b2) if the charge state of the starting capacitor before the AC supply voltage was applied was above a predefineable limit value: triggering the starting device and thus switching on the fluorescent lamp with LED switch switched off and thus at least one LED switched off.

16. The circuit arrangement as claimed in claim 14, wherein the auxiliary rectifier is dimensioned to provide a voltage at its output which corresponds to at most 35 V.

* * * * *